United States Patent [19]

Neuroth

[11] Patent Number: 4,854,886

[45] Date of Patent: Aug. 8, 1989

[54] ELECTRICAL PENETRATOR FOR HOT, HIGH PRESSURE SERVICE

[75] Inventor: David H. Neuroth, Hamden, Conn.

[73] Assignee: Hubbell Incorporated, Orange, Conn.

[21] Appl. No.: 912,824

[22] Filed: Sep. 29, 1986

[51] Int. Cl.[4] ..... H01R 4/60

[52] U.S. Cl. ..... 439/192; 439/191; 439/275; 439/276

[58] Field of Search ..... 439/190–192, 439/194, 201, 204, 205, 275, 276, 283, 197, 195

[56] References Cited

U.S. PATENT DOCUMENTS

| | | | |
|---|---|---|---|
| 2,177,508 | 10/1939 | Abbott | 201/64 |
| 2,760,175 | 8/1956 | Dunn | 339/94 |
| 3,197,730 | 7/1965 | Hargett | 339/102 |
| 3,681,739 | 8/1972 | Kornick | 339/94 C |
| 3,989,330 | 11/1976 | Cullen et al. | 339/16 R |
| 4,050,765 | 9/1977 | Duesserhoept et al. | 439/204 |
| 4,060,299 | 11/1977 | Williams | 339/94 R |
| 4,154,302 | 5/1979 | Cugini | 339/94 M |
| 4,500,156 | 2/1985 | Nguyen | 439/190 |
| 4,553,807 | 11/1985 | Cane | 439/190 |
| 4,588,247 | 5/1986 | Grappe et al. | 339/94 M |
| 4,589,717 | 5/1986 | Pottier et al. | 339/94 M |
| 4,693,540 | 9/1987 | Cane | 439/198 |
| 4,727,223 | 2/1988 | Lee et al. | 174/151 |

FOREIGN PATENT DOCUMENTS 860048 2/1961 United Kingdom .

*Primary Examiner*—P. Austin Bradley

*Attorney, Agent, or Firm*—Jerry M. Presson; Alfred N. Goodman

[57] ABSTRACT

An electrical coupling for conducting electricity between areas of different pressures including a hollow housing extending between the areas of different pressures, an electrical cable extending through the housing, a seal located in the housing, a compression assembly for compressing the seal, a first pressure-equalizing assembly at one end of the housing for maintaining the pressure inside the housing at least equal to the pressure outside the housing at that end, and a second pressure-equalizing assembly at the other end of the housing for maintaining the pressure inside the housing at least equal to the pressure outside the housing at that other end. Each of the pressure-equalizing assemblies comprises a dielectric flowable grease filling the otherwise empty spaces inside the housing and a movable wall, that is exposed to the exterior pressure, pressurizing the grease. These pressure-equalizing assemblies perform an electrical insulating function by preventing contaminants from reaching the electrical cable.

33 Claims, 5 Drawing Sheets

ELECTRICAL PENETRATOR FOR HOT, HIGH PRESSURE SERVICE

FIELD OF THE INVENTION

The invention relates to an electrical coupling for conducting electricity between areas of different pressures. More particularly, the invention relates to an electrical penetrator for use in an oil well packer to conduct electricity between low and high pressure areas found in an oil well.

In various applications of electrical power cable, it is necessary to carry electricity from a low pressure region to a high pressure region, or vice versa. For example, electrical submersible pumping systems used in oil wells often contain a seal device, usually referred to as a packer, to isolate one portion of the well from another. Electrical power in these instances must be taken through the packer to energize, for example, a pump motor below the packer. The device for conducting electricity through the packer is usually referred to as a penetrator.

In these environments, the main problem associated with the penetrator is to avoid disruption of the electrical connection due to leakage in the penetrator and exposure of the electrical conductors to oil, brine and other oil well fluids. In addition, these penetrators must be operable over a wide range of temperatures, typically from freezing to 300° F. or more and therefore must absorb stresses from thermal expansion. Likewise, the penetrators typically are exposed to pressure differentials up to 5,000 psi.

While many prior art penetrators are known, they have numerous disadvantages. First, many of these prior art devices do not provide adequate sealing against contamination from external fluids, resulting in a degradation of the electrical insulation of the penetrator. In addition, many of these prior art devices are exposed to significant shear stresses during thermal expansion and tend to degrade over time. Finally, many of these devices combine the sealing and insulation functions, usually Examples of these prior art devices are disclosed in the following U.S. Pat. Nos. 2,177,508 to Abbott; 2,760,175 to Dunn; 3,197,730 to Hargett; 3,681,739 to Kornick; 3,989,330 to Cullen et al; 4,060,299 to Williams; 4,154,302 to Cugini; 4,588,247 to Grappe et al; and 4,589,717 to Pottier et al.

SUMMARY OF THE INVENTION

Accordingly, a primary object of the present invention is to provide an electrical coupling in the form of a penetrator for hot, high pressure service which is reliable, durable and provides a viable sealing of the interface between areas of different pressure, while resisting degradation of the electrical insulation therethrough.

Another object of the invention is to provide an electrical penetrator that separates the electrical, insulation function from the sealing function and also prevents shear stresses within the sealing member by transferring these stresses to other high-strength members.

Another object of the invention is to provide a pressure-equalizing assembly at opposite ends of the penetrator to assure that the interior of the penetrator has a pressure equal to or greater than the exterior pressure on the opposite ends of the penetrator to protect the interior from contamination by external fluids.

The foregoing objects are basically attained by providing an electrical coupling for conducting electricity between areas of different pressures, the combination comprising a hollow housing having first and second open ends, a longitudinal axis, and an inner tubular surface, the first and second open ends being located respectively in areas of different pressures; an electrical cable extending through the housing along the longitudinal axis thereof, the electrical cable comprising a first electrical conductor extending into the first open end, a second electrical conductor extending into the second open end, and a connector assembly, located in the housing, for electrically connecting the conductors; a seal, located inside the housing and engaging the inner surface, for sealing the housing and electrical cable between the first and second ends of the housing; a first pressure-equalizing assembly, coupled to the housing, for maintaining the pressure inside the housing on a first side of the seal at least equal to the pressure acting on the first end of the housing; and a second pressure-equalizing assembly, coupled to the housing, for maintaining the pressure inside the housing on a second side of the seal at least equal to the pressure acting on the second end of the housing.

Other objects, advantages and salient features of the invention will become apparent from the following detailed description, which, taken in conjunction with the annexed drawings, disclose preferred embodiments of the invention.

DRAWINGS

Referring now to the drawings which form a part of this original disclosure:

DETAILED DESCRIPTION OF THE INVENTION

Figure 1:
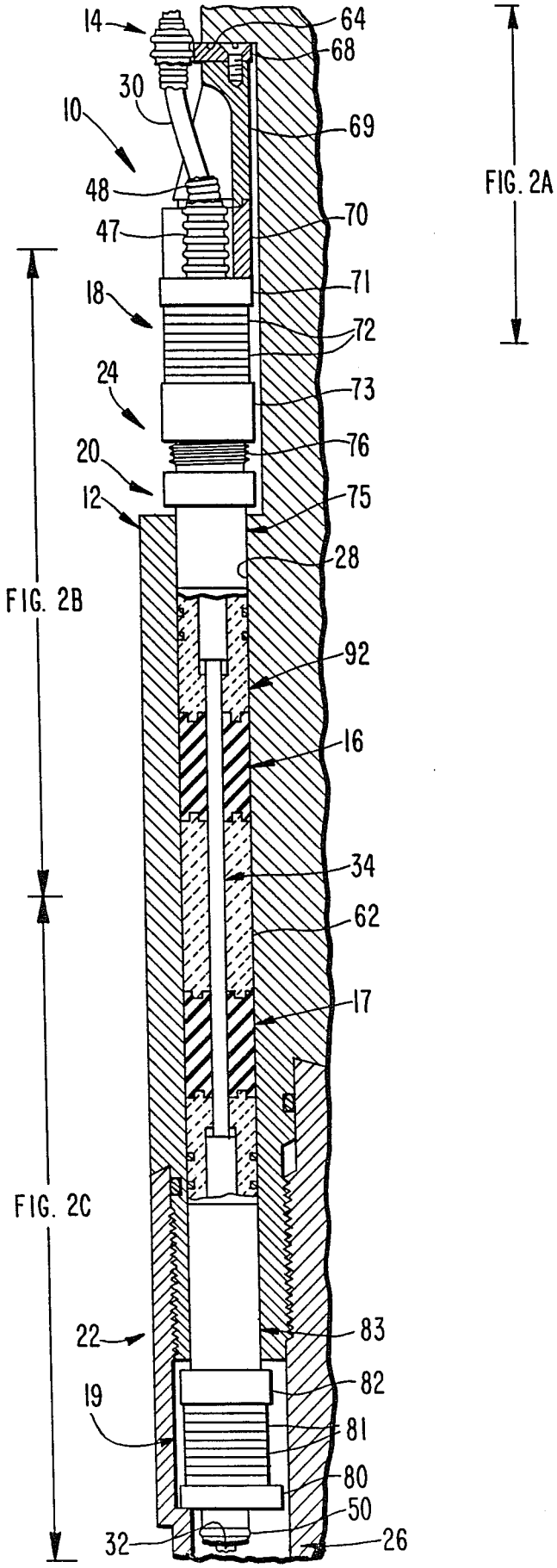
FIG. 1 is a front elevational view in partial section showing the electrical coupling in accordance with the present invention for conducting electricity between areas of different pressures.

Referring now to FIGS. 1 and 2A–C, the electrical coupling 10 in accordance with the invention is shown comprising a hollow housing 12, an electrical cable 14, a pair of seals 16 and 17, compression assemblies 18 and 19 for compressing the seals, and first and second pressure-equalizing assemblies 20 and 22. The hollow housing 12 has a first open end 24 and a second open end 26, these ends being located respectively in areas of different pressure. Thus, the aim of the electrical coupling 10 in accordance with the invention is to seal the coupling between these two areas of differing pressure via seals 16 and 17, and also avoid contamination via brine, oil and other oil well fluids of the electrical insulation therethrough. Contamination is avoided, as described in more detail hereinafter, via the first and second pressure-equalizing assemblies 20 and 22 which maintain the pressure inside the hollow housing 12 equal to or greater than the pressure acting respectively on the first and second open ends of the housing. This is basically accomplished by filling the otherwise empty spaces inside the housing with a dielectric flowable material and having a movable wall, that is exposed to the exterior pressure, pressurizing an internal reservoir cavity containing the flowable material.

As seen in FIGS. 1 and 2A–C, the hollow housing 12 has a longitudinal axis and an inner tubular surface 28 in the form of a cylinder. The seals 16 and 17 engage this inner tubular surface 28 and seal against it.

The electrical cable 14 comprises a first electrical conductor 30 extending into the first open end 24 of the housing, a second electrical conductor 32 extending into the second open end 26 of the housing, and an electrical connector 34 electrically connecting these two conductors. As seen in FIG. 2B, the first electrical conductor 30 has a threaded end 36 threadedly engaging a pin 38 and likewise as seen in FIG. 2C, the second electrical conductor 32 has a threaded end 40 threadedly engaged with a pin 42. The electrical connector 34 is essentially an elongated conducting rod as seen in FIGS. 2B and 2C, the ends thereof being rigidly coupled to a pair of sleeves 44 and 45 which slidably receive the pins 38 and 42 therein. Thus, the electrical connector 34 provides electrical continuity between the first and second conductors 30 and 32 and also a slidable connection therebetween to take into account any thermal expansion of the insulating material surrounding the connector 34 or other expansion of the electrical coupling 10. As seen in FIGS. 1, 2B and 2C, the electrical connector 34 passes through and is sealed against seals 16 and 17.

As seen in FIGS. 1 and 2A–C, the first electrical conductor 30 has a longitudinally expansible, steel bellows sheath 47 surrounding it, with vulcanized insulating filler material 48 interposed and filling the space between the conductor and bellows sheath. The electrical conductor can initially have insulation thereon and an added layer of filler material can be used, although during vulcanization the insulation and the filler material will form a monolithic layer bonding the conductor to the bellows sheath. A similar bellows sheath 50 and filler material 51 are associated with and surround the second electrical conductor 32.

Figure 2A:
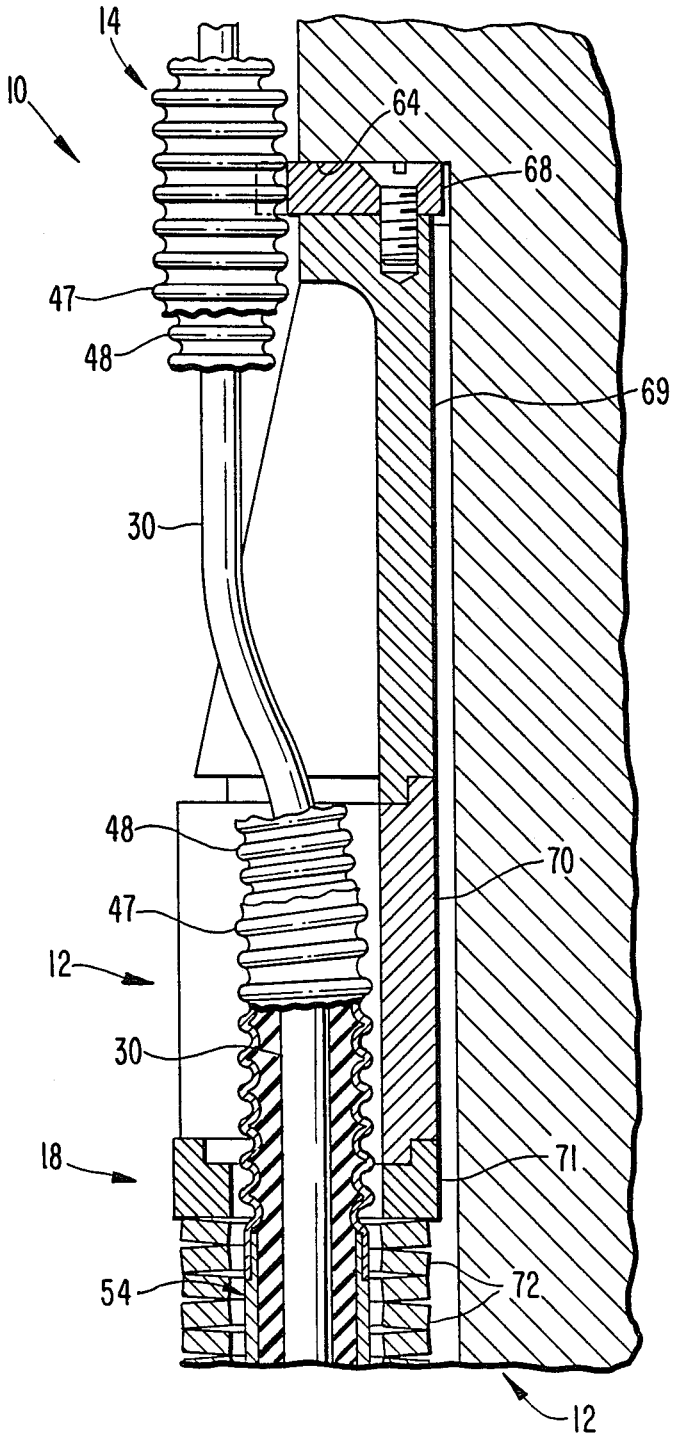
FIG. 2A is an enlarged, front elevational view in partial section of the present invention showing the electrical coupling in more detail as depicted in the upper third of FIG. 1.
Figure 2B:
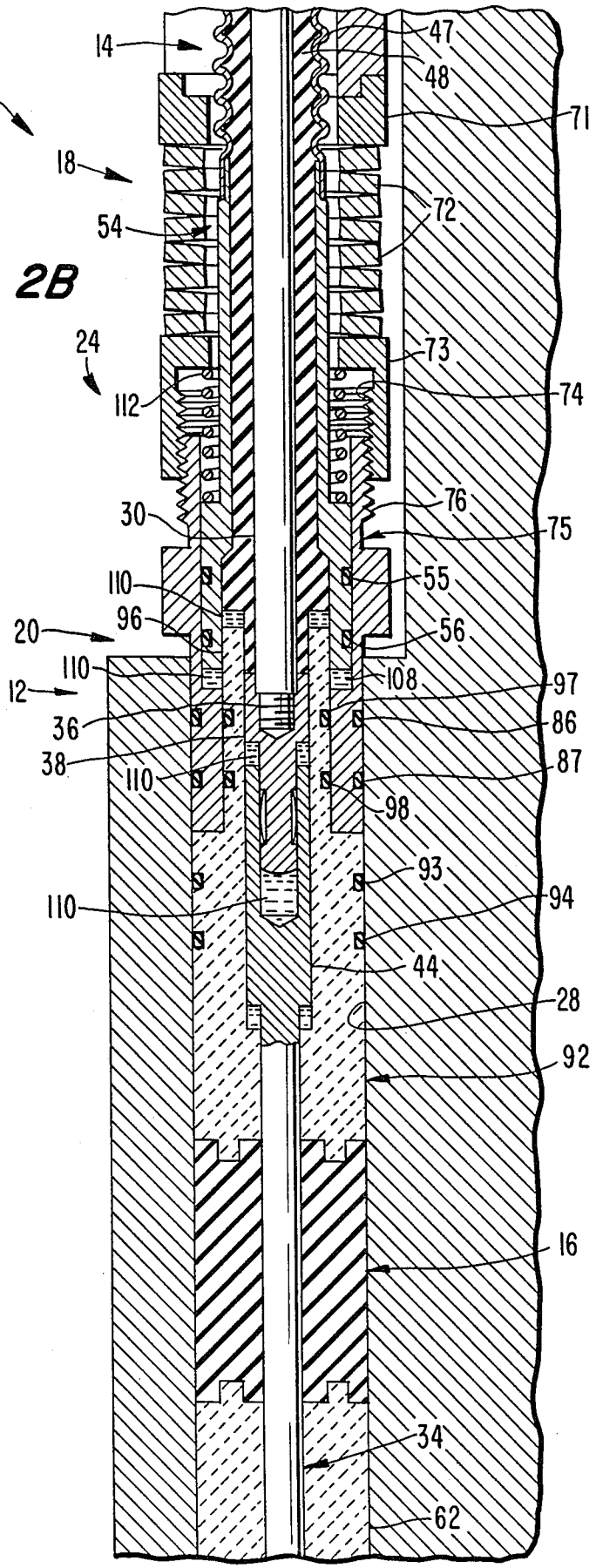
FIG. 2B is an enlarged, front elevational view in partial section of the invention showing the electrical coupling in more detail as depicted in the center of FIG. 1.
Figure 2C:
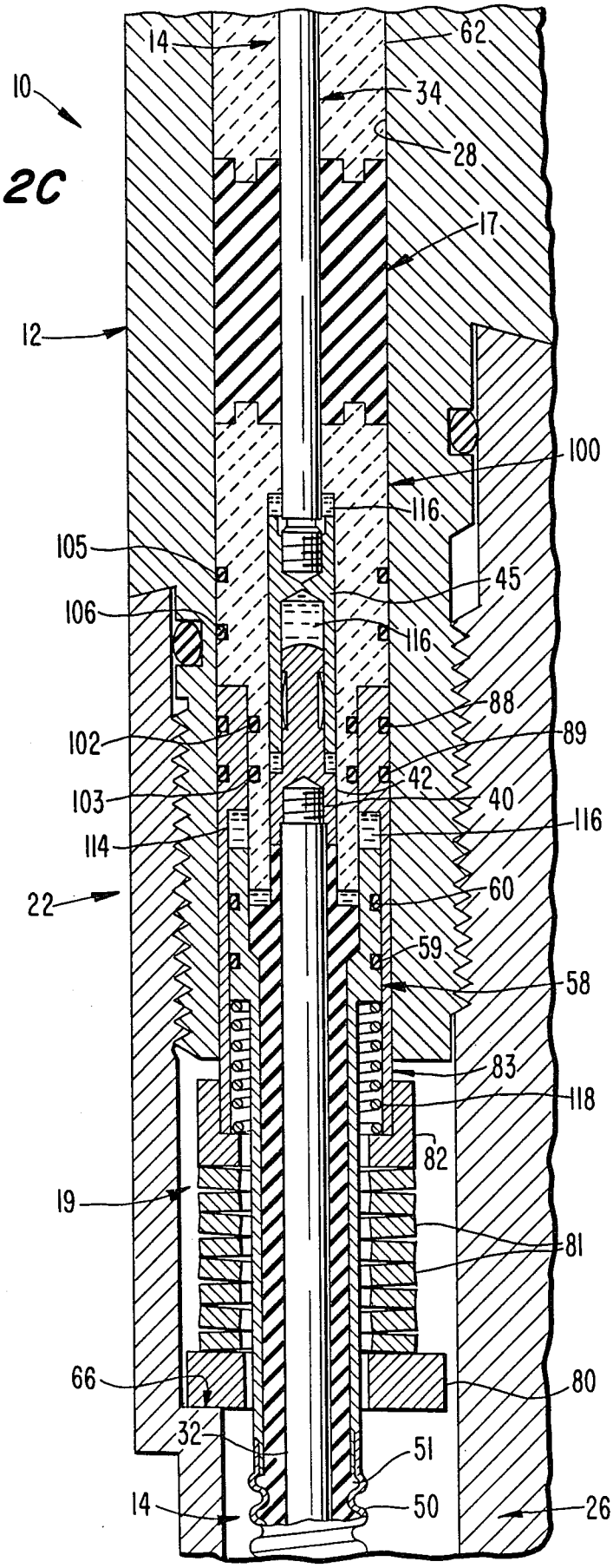
FIG. 2C is an enlarged, front elevational view in partial section of the invention showing the electrical coupling in more detail as depicted in the bottom third of FIG. 1.

As seen in FIGS. 2A and 2B, a first metallic sleeve 54 is rigidly coupled, such as by welding, to the end of bellows sheath 47 and extends downwardly therefrom, this sleeve 54 enclosing the filler material 48 therein and also surrounding the electrical cable 14. This sleeve 54 has a pair of O-ring seals 55 and 56 on its outer surface. As seen in FIG. 2C, a similar second sleeve 58 is rigidly coupled to and extends upwardly from the end of bellows sheath 50 and has a pair of O-ring seals 59 and 60 on its outer surface. This second sleeve 58 encloses the filler material 51 as well as the electrical cable 14.

The first and second sleeves 54 and 58 are free to slide axially of the hollow housing 12 since the pin 38 can slide in connector 34 and conductor 30 can translate up or down since it is not rigidly attached to any fixed structure.

As seen in FIGS. 1, 2 and 2C, the seals 16 and 17, which are advantageously formed of rubber and are cylindrical, have a dielectric spacer 62 therebetween. This spacer slidably engages the inner wall 28 of the housing and has a central opening for receiving the electrical conductor 34 therein. The dielectric spacer 62 is advantageously formed of a ceramic material such as a high-strength porcelain and is reinforced as necessary to accept high compression loads.

In order to place the seals 16 and 17 in pre-loaded axial compression directed from both ends of the hollow housing, the pair of compression assemblies 18 and 19 are utilized.

As seen in FIGS. 1, 2A and 2C, the compression assemblies act against first shoulder 64 adjacent the first open end of the housing and second shoulder 66 adjacent the second open end of the housing. The first shoulder 64 is on a first side of the housing 12 and faces towards seals 16 and 17, while the second shoulder 66 is on the other side of the seals and faces towards the seals. With the compression assemblies 18 and 19 acting against the first and second shoulders, the compressive force therefrom is translated to the seals 16 and 17, thereby pressure energizing them into sealing engagement with the inner surface 28 of the hollow housing as well as the outer surface of the electrical connector 34.

The first compression assembly 18 as seen in FIGS. 1, 2A and 2B comprises a plate 68 engaging first shoulder 64, two rigid channel members 69 and 70 extending downwardly from plate 68, a ring 71 engaging the lower channel member 70, a series of Bellville washers 72, a ring 73 with internal threads 74, and a first tubular member 75 having external threads 76 threadedly engaged with internal threads 74. Advantageously, the Bellville washers can provide a pre-load compression force of from about 1,000 to about 5,000 psi at about 75° F.

As seen in FIGS. 1 and 2C, the second compression assembly 19 is similar to the first compression assembly 18 and comprises from the bottom up a ring 80 engaging second shoulder 66, a series of Bellville spring washers 81 engaging the ring 80, a ring 82 engaging the washers, and a second tubular member 83 engaging ring 82.

As seen in FIG. 2B, the first tubular member 75 has a pair of O-ring seals 86 and 87 on the outer surface thereof which sealingly engage the inner tubular surface 28 on the hollow housing 12. Likewise, the second tubular member 83 in the second compression assembly 19 as seen in FIG. 2C has a pair of O-ring seals 88 and 89 on the outer surface thereof which sealingly engage the inner tubular surface 28 on the housing. These seals are not necessary to the operation of the invention but are used to add redundancy as they tend to slow down inward infiltration of contaminants and outward flow of the dielectric flowable material.

As seen in FIGS. 1 and 2B, forming the bottom portion of the first compression assembly 18 is a third tubular member 92 formed of dielectric material such as high strength ceramic material including high strength porcelain. This third tubular member 92 has a pair of O-ring seals 93 and 94 on the outer surface thereof for sealing engagement with the inner surface 28 on the housing. The third tubular member also has a central passageway for receiving the electrical cable 14 therethrough. At an upper reduced diameter portion 96, the third tubular member 92 has a pair of O-ring seals 97 and 98 which sealingly engage the inner surface of the first tubular member 75. As seen in FIG. 2B, the outer surface of the reduced diameter portion 96 is in slidable engagement with the inner surface of the first tubular member 75 and also a portion of the inner surface of the first sleeve 54. Since the bottom surface of the first tubular member 75 engages an upwardly facing shoulder on the third tubular member, downward compression via the Bellville washers 72 is translated to the third tubular member 92 which in turn compresses seal 16. Since the first and third tubular members 75 and 92 are subject to shearing forces and the bottom of third tubular member 75 has a matching annular surface engaging seal 16, seal 16 is not subject to shearing forces and hence has no shear stresses within it.

As seen in FIG. 2C, a corresponding fourth tubular member 100 is provided as the end of the second compression assembly 19, this fourth tubular member engaging at one side seal 17 and at the other the second tubular member 83 which is compressed via the lower series of Bellville spring washers 81. The fourth tubular member 100 has a pair of O-ring seals 102 and 103 on its outer surface sealingly engaging the inner surface of the second tubular member 83 and also has a second pair of O-ring seals 105 and 106 on its outer surface sealingly engaging the inner tubular surface 28 on the housing. The second and fourth tubular members 83 and 100 isolate seal 17 from shear stresses as described above regarding members 75 and 92 and seal 16.

As seen in FIG. 2B, the first pressure-equalizing assembly 20 is comprised of an annular reservoir cavity 108 having a movable upper wall defined by the downwardly facing annular bottom wall of the first sleeve 54. The remaining parts defining annular cavity 108 are the inwardly facing annular surface of the first tubular member 75, an annular upwardly facing surface on the first annular member 75, and an outwardly facing annular surface on the third tubular member 92. Contained inside the annular cavity 108 is a flowable material such as a dielectric grease or oil 110.

This flowable material also fills all of the otherwise empty spaces inside the housing above seal 16 except it normally will not extend past O-rings 97 and 98. Thus, the material is pre-applied to and fills all spaces between pin 38 and sleeve 44, all spaces between member 92 and sleeve 44 as well as surface 28, all spaces between sleeve 54 and member 92, and all spaces between filler material 48 and member 92. This flowable material is substantially incompressible and is maintained at a pressure equal to or greater than the exterior pressure acting on the first open end of the housing since slidable sleeve 54 is exposed to the exterior pressure and acts on the flowable material in reservoir cavity 108.

A coiled spring 112 acting between ring 73 and the first sleeve 54 biases the sleeve downwardly to provide a slight extra pressure of from about 10–20 psi on the sleeve in order to help gradually remove any air trapped in annular cavity 108 by slowly exhausting past O-rings 55 and 56.

In a similar fashion as seen in FIG. 2C, a second annular reservoir cavity 114 is formed by the second sleeve 58, second tubular member 83, and fourth tubular member 100, with the upper annular surface of the second sleeve 58 forming a movable wall in annular cavity 114. This cavity contains therein flowable material 116, which is substantially incompressible and formed from a dielectric grease or oil, and this flowable material 116 also fills all of the otherwise empty spaces inside the housing below seal 17. A spring 118 similar to spring 112 discussed above is also provided to bias sleeve 58 towards seal 17.

In operation, once the electrical cable 14, seals 16 and 17, compression assemblies 18 and 19, and first and second pressure-equalizing assemblies 20 and 22 are installed inside the hollow housing 12, the series of Bellville washers 72 and 81 compress the seals 16 and 17 along the longitudinal axis of the housing, thereby pressure energizing the seals into sealing engagement with the inner surface 28 of the housing and the outer surface of the electrical connector 34. Any increase in pressure at the first or second open ends of the housing will merely cause an additional increase in compression of the seals above that already imposed by the Belleville spring washers as the pressure acts on the various parts of the coupling.

During any increase or decrease in pressure or increase or decrease in temperature, any relative movement of the electrical conductors 30 and 32 will be absorbed by the slidable connections formed by the electrical connector 34. Moreover, the seals 16 and 17 are held in uniform hydrostatic equilibrium by these slidable connections and therefore the seals do not experience any shear stress which would possibly degrade them. Instead, shear stresses are assumed by tubular members 75 and 92 and 83 and 100.

In addition, the first and second pressure-equalizing assemblies 20 and 22 maintain the pressure inside the annular cavities 108 and 114 and surrounding the electrical cable 14 inside housing 12 equal to or greater than the exterior pressure acting respectively on the first and second open ends of the housing. Thus, there is no pressure gradient, but rather a hydrostatic equilibrium, across the electrical coupling 10 tending to drive contaminating oil, brine or other oil well fluids into the electrical cable 14 and thereby contaminating the electrical insulation thereof or making their way into the region of the electrical connector 34. This mechanism is due to the presence of the pressurized flowable material located inside the housing.

In this regard, any exterior pressure experienced by either of the open ends of the housing is merely transmitted to the slidably movable first or second sleeves 54 and 58 which in turn increase the pressure on the flowable material 108 and 116 located in these cavities and extending continuously therefrom and filling all other otherwise empty spaces in the housing. Since these flowable materials are substantially incompressible, the increase in pressure on them merely serves to increase the pressure in the housing, thereby eliminating any pressure differential between the exterior of the electrical coupling 10 and the interior of the housing surrounding the electrical cable 14. In addition, the O-ring seals 55 and 56 on the first sleeve 54 and O-ring seals 59 and 60 on the second sleeve 58 tend to resist entrance of contaminating liquid into the electrical cable. However, since these O-ring seals are on the slidable sleeves, they are subject to degradation. But, even if these seals fail, the annular cavities with the flowable material therein are pressurized and resist infiltration of contaminating liquids or gases.

EMBODIMENT OF FIG. 3

Figure 3:
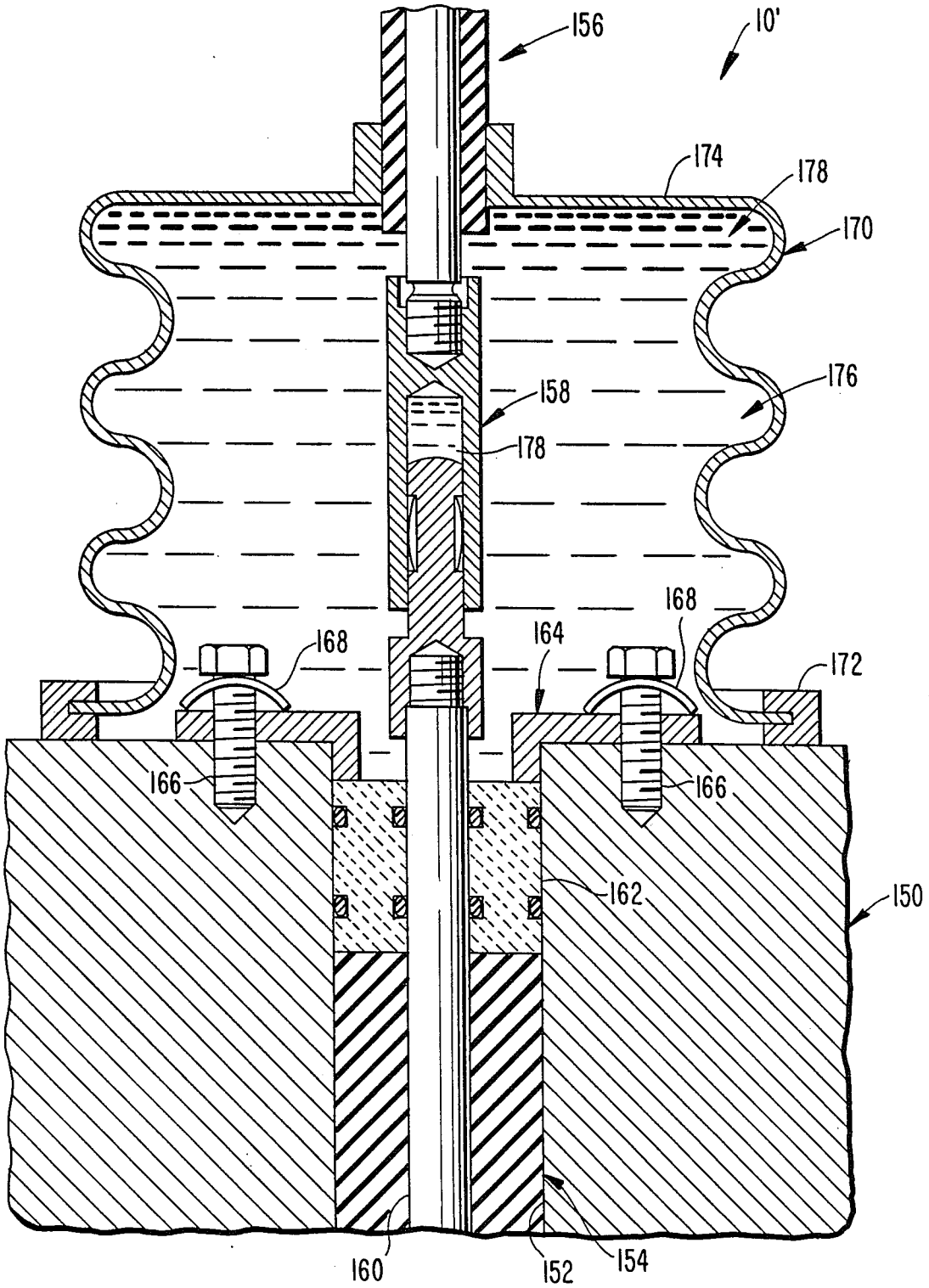
FIG. 3 is a front elevational view in partial section of a modified embodiment in accordance with the present invention.

As shown in FIG. 3, a modified electrical coupling 10' in accordance with the invention is shown which operates in a manner similar to that disclosed in FIGS. 1 and 2A–C, although it is constructed differently.

As seen in FIG. 3, a hollow housing 150 is provided having a cylindrical inner surface 152 with a cylindrical rubber seal 154 located therein.

At the top of FIG. 3 is an insulated conductor 156 having a slidable electrical connector 158 at its end, this connector having a conductor 160 extending therefrom and through seal 152. This conductor 160 also passes through a cylindrically shaped dielectric tubular member 162 located inside the hollow housing and engaging the seal 154. Biasing the tubular member 162 downwardly is a ring 164 coupled to the top of the housing via bolts 166. This ring 164 is biased downwardly to compress tubular member 162 into seal 154 via springs 168, which can be in the form of Bellville washers.

On top of the housing 150 is a steel bellows 170 which has an open bottom end rigidly coupled to the top of the housing via any suitable means such as a ring 172 rigidly coupled to the housing. The top of the bellows 170 has a wall 174 receiving the insulated conductor 156 therethrough. The wall and conductor are suitably sealed and rigidly coupled together.

The inside of the bellows 170 defines an annular reservoir cavity 176 containing therein a flowable material 178 in the form of a dielectric grease or oil.

As in the embodiment discussed above regarding FIGS. 1 and 2A–C, a second set of the elements shown in FIG. 3 are provided at the other end of the housing 150 so that the overall apparatus is substantially symmetrical on opposite sides of the seal 154.

Thus, in a similar fashion as the embodiment shown in FIGS. 1 and 2A–C, the seal 154 is pressure energized by means of ring 164 being spring biased downwardly into engagement with tubular member 162 which in turn engages seal 154.

Likewise, thermal expansion and pressure differentials to which the apparatus 10' is exposed are absorbed by the slidable electrical connection via connector 158 with regard to conductor 156 and conductor 160.

In addition, any increase in pressure acting on the top of housing 150 in turn tends to move wall 174 downwardly, thereby increasing the pressure on the flowable material 178 inside the bellows 170. Thus, the pressure inside the bellows and adjacent the electrical connector and conductors is maintained equal to or greater than the pressure acting on the upper end of housing 150. Therefore, there is no pressure differential tending to drive contaminating fluids into the electrical connection provided by the coupling.

While other advantageous embodiments have been chosen to illustrate the invention, it will be understood by those skilled in the art that various changes and modifications can be made therein without departing from the scope of the invention as defined in the appended claims.

What is claimed is:

1. An electrical coupling for conducting electricity between areas of different pressures, the combination comprising:

a hollow housing having first and second open ends, a longitudinal axis, and an inner tubular surface, said first and second open ends being located respectively in areas of different pressures;

an electrical cable extending through said housing along said longitudinal axis thereof, said electrical cable comprising a first electrical conductor extending into said first open end, a second electrical conductor extending into said second open end, and connector means, located in said housing, for electrically connecting said conductors;

seal means, located inside said housing and engaging said inner surface, for sealing said housing and electrical cable between said first and second ends of said housing;

first pressure-equalizing means, coupled to said housing, for maintaining the pressure inside said housing on a first side of said seal means at least equal to the pressure acting on said first end of said housing; and second pressure-equalizing means, coupled to said housing, for maintaining the pressure inside said housing on a second side of said seal means at least equal to the pressure acting on said second end of said housing, said first pressure-equalizing means comprising a first longitudinally movable wall exposed to the pressure acting on said first end of said housing, and said second pressure-equalizing means comprising a second longitudinally movable wall exposed to the pressure acting on said second end of said housing.

2. An electrical coupling according to claim 1, wherein said first pressure-equalizing means comprises a first substantially incompressible, dielectric flowable material located inside said housing on a first side of said seal means, and said second pressure-equalizing means comprises a second substantially incompressible, dielectric flowable material located inside said housing on a second side of said seal means.

3. An electrical coupling according to claim 1, and further comprising a first substantially incompressible, dielectric flowable material located inside said housing between said first movable wall and said seal means and filling all of the otherwise empty spaces located inside said housing and between said first movable wall and said seal means, and a second substantially incompressible, dielectric flowable material located inside said housing between said second movable wall and said seal means and filling all of the otherwise empty spaces located inside said housing and between said second movable wall and said seal means.

4. An electrical coupling according to claim 3, and further comprising compression means, coupled to said housing, for exerting an axially directed compression force on said seal means from said first and second ends of said housing.

5. An electrical coupling according to claim 4, wherein said compression means comprises a tubular member enclosing part of said electrical cable and engaging one side of said seal means, and another tubular member enclosing another part of said electrical cable and engaging the other side of said seal means.

6. An electrical coupling for conducting electricity between areas of different pressures, the combination comprising:

a hollow housing having first and second open ends, a longitudinal axis, and an inner tubular surface, said first and second open ends being located respectively in areas of different pressures;

an electrical cable extending through said housing along said longitudinal axis thereof, said electrical cable comprising a first electrical conductor extending into said first open end, a second electrical conductor extending into said second open end, and connector means, located in said housing, for electrically connecting said conductors;

seal means, located inside said housing and engaging said inner surface, for sealing said housing and electrical cable between said first and second ends of said housing;

means, coupled to said housing, for preventing infiltration of exterior fluids into said electrical cable; and compression means, coupled to said housing, for exerting an axially directed compression force on said seal means from said first and second ends of said housing;

said compression means comprising means for isolating said seal means from shear stresses.

7. An electrical coupling according to claim 6, wherein said means for isolating said seal means from shear stresses comprises a first pair of interengaging high-strength tubular members, one of which engages one side of said seal means, and a second pair of interengaging high-strength tubular members, one of which engages another side of said seal means.

8. An electrical coupling for conducting electricity between areas of different pressures, the combination comprising:

a hollow housing having first and second open ends, a longitudinal axis, and an inner tubular surface, said first and second open ends being located respectively in areas of different pressures;

an electrical cable extending through said housing along said longitudinal axis thereof, said electrical cable comprising a first electrical conductor extending into said first open end, a second electrical conductor extending into said second open end, and connector means, located in said housing, for electrically connecting said conductors;

seal means, located inside said housing and engaging said inner surface, for sealing said housing and electrical cable between said first and second ends of said housing;

compression means, coupled to said housing, for exerting an axially directed compression force on said seal means from said first and second ends of said housing;

first pressure-equalizing means, coupled to said housing, for maintaining the pressure inside said housing on a first side of said seal means at least equal to the pressure acting on said first end of said housing; and second pressure-equalizing means, coupled to said housing, for maintaining the pressure inside said housing on a second side of said seal means at least equal to the pressure acting on said second end of said housing.

9. An electrical coupling according to claim 8, wherein said means for electrical connecting said conductors comprises means for slidably connecting said conductors.

10. An electrical coupling according to claim 8, wherein said seal means comprises a tubular elastomeric member receiving said electrical cable therein.

11. An electrical coupling according to claim 8, wherein said first pressure-equalizing means comprises a first substantially imcompressible, dielectric flowable material located inside said housing on a first side of said seal means, and said second pressure-equalizing means comprises a second substantially incompressible, dielectric flowable material located inside said housing on a second side of said seal means.

12. An electrical coupling according to claim 8, wherein said first pressure-equalizing means comprises a first movable wall exposed to the pressure acting on said first end of said housing, and said second pressure-equalizing means comprises a second movable wall exposed to the pressure acting on said second end of said housing.

13. An electrical coupling according to claim 12, and further comprising a first substantially incompressible, dielectric flowable material located inside said housing between said first movable wall and said seal means and filling all of the otherwise empty spaces located inside said housing and between said first movable wall on said seal means, and a second substantially incompressible, dielectric flowable material located inside said housing between said second movable wall and said seal means and filling all of the otherwise empty spaces located inside said housing and between said second movable wall and said seal means.

14. An electrical coupling according to claim 8, wherein said first pressure-equalizing means comprises a second movable wall exposed to the pressure acting on said first end of said housing, and said second pressure-equalizing means comprises second movable wall exposed to the pressure acting on said second end of said housing.

15. An electrical coupling according to claim 14, wherein said first movable wall comprises a first sleeve axially slidable along said longitudinal axis of said housing, and said second movable wall comprises a second sleeve axially slidable along said longitudinal axis of said housing.

16. An electrical coupling according to claim 15, and further comprising a first bellows sheath enclosing said first electrical conductors with filler material interposed therebetween, said first bellows sheath being rigidly coupled to said first sleeve, and a second bellows sheath enclosing said second electrical conductor with filler material interposed therebetween, said second bellows sheath being rigidly coupled to said second sleeve.

17. An electrical coupling according to claim 15, and further comprising first biasing means, coupled to said housing, for biasing said first sleeve towards said seal means, and second biasing means, coupled to said housing, for biasing said second sleeve towards said seal means.

18. An electrical coupling according to claim 8, wherein said compression means comprises a first shoulder located on said housing on a first side of said seal means and facing towards said seal means, a second shoulder located on said housing on a second side of said seal means and facing towards said seal means, and biasing means, acting on said shoulders and said seal means, for axially compressing said seal means.

19. An electrical coupling according to claim 18, wherein said compression means further comprises
a first tubular member, and
a second tubular member.

20. An electrical coupling according to claim 19, wherein said compression means further comprises
a third tubular member, and
a fourth tubular member.

21. An electrical coupling according to claim 20, wherein
said third tubular transmits said compression force to said seal means, and
said fourth tubular member transmits said compression force to said seal means.

22. An electrical coupling according to claim 20, wherein
said first and third tubular members are slidably engaged, and
said second and fourth tubular members are slidably engaged.

23. An electrical coupling according to claim 20, and further comprising
a first bellows sheath enclosing said first electrical conductor with filler material interposed therebetween, said third tubular member engaging said filler material, and
a second bellows sheath enclosing said second electrical conductor with filler material interposed therebetween, said fourth tubular member engaging said filler material.

24. A method of conducting electricity between first and second areas of different pressures and in the presence of contaminating fluids located in the first and second areas, comprising the steps of
placing a hollow housing having first and second open ends between the first area and the second area with the first end exposed to the pressure in the first area and the second end exposed to the pressure in the second area,
inserting a first electrical conductor into the first open end, inserting a second electrical conductor into the second open end, and electrically coupling the conductors together via an electrical connector inside the housing,
maintaining the pressure in the housing on a first side facing the first open end at least equal to the pressure in the first area, thereby resisting passage of the contaminating fluids located in the first area into the connector, and
maintaining the pressure in the housing on a second side facing the second open end at least equal to the pressure in the second area, thereby resisting passage of the contaminating fluids located in the second area into the conductor,
the two maintaining steps including forming a sealing zone in the housing by sealing between the conductors and the connector and the housing along part of the length of the housing between the first and second ends,
the forming step comprising the step of pre-pressurizing the sealing zone.

25. A method according to claim 24, wherein
the first maintaining step includes the step of filling all empty spaces in the housing on the first side with a substantially incompressible, dielectric flowable material, and
the second maintaining step includes the step of filling all empty spaces in the housing on the second side with a substantially incompressible, dielectric flowable material.

26. A method according to claim 25, wherein
the first maintaining step further includes applying a first compressive force directed towards the second side of the housing on the flowable material located on the first side of the housing, and
the second maintaining step further includes applying a second compressible force directed towards the first side of the housing on the flowable material located on the second side of the housing.

27. A method according to claim 25, wherein
the first maintaining step further includes locating a first movable wall in the housing on the first side of the housing which engages the flowable material therein and is exposed to the pressure in the first area, and
the second maintaining step further includes locating a second movable wall in the housing on the second side of the housing which engages the flowable material therein and is exposed to the pressure in the second area.

28. A method according to claim 27, wherein
the first maintaining step further includes applying a first compressible force to the first movable wall in a direction towards the second side of the housing, and
the second maintaining step further includes applying a second compressible force to the second movable wall in a direction towards the first side of the housing.

29. A method of conducting electricity between first and second areas of different pressures and in the presence of contaminating fluids located in the first and second areas, comprising the steps of
placing a hollow housing having first and second open ends between the first area and the second area with the first end exposed to the pressure in the first area and the second end exposed to the pressure in the second area,
inserting a first electrical conductor into the first open end, inserting a second electrical conductor into the second open end, and electrically coupling the conductors together via an electrical connector inside the housing,
forming a sealing zone in the housing by sealing between the conductors and connector and the housing along a part of the length of the housing between the first and second ends,
maintaining the pressure in the housing on a first side of the sealing zone facing the first open end at least equal to the pressure in the first area, thereby resisting passage of the contaminating fluids located in the first area into the connector and across the sealing zone, and
maintaining the pressure in the housing on a second side of the sealing zone facing the second open end at least equal to the pressure in the second area, thereby resisting passage of the contaminating fluids located in the second area into the connector and across the sealing zone,
the forming step comprising the step of pre-pressurizing the sealing zone.

30. A method according to claim 29, wherein
the first maintaining step includes the step of filling all empty spaces in the housing on the first side of the sealing zone with a substantially incompressible, dielectric flowable material, and the second maintaining step includes the step of filling all empty spaces in the housing on the second side of the sealing zone with a substantially incompressible, dielectric flowable material.

31. A method according to claim 30, wherein the first maintaining step further includes applying a first compressible force directed towards the sealing zone on the flowable material located on the first side of the sealing zone, and the second maintaining step further includes applying a second compressible force directed towards the sealing zone on the flowable material located on the second side of the sealing zone.

32. A method according to claim 30, wherein the first maintaining step further includes locating a first movable wall in the housing on the first side of the sealing zone which engages the flowable material therein and is exposed to the pressure in the first area, and the second maintaining step further includes locating a second movable wall in the housing on the second side of the sealing zone which engages the flowable material therein and is exposed to the pressure in the second area.

33. A method according to claim 32, wherein the first maintaining step further includes applying a first compressive force to the first movable wall in a direction towards the sealing zone, and the second maintaining step further includes applying a second compressive force to the second movable wall in a direction towards the sealing zone.

* * * * *

UNITED STATES PATENT AND TRADEMARK OFFICE

CERTIFICATE OF CORRECTION

PATENT NO. : 4,854,886

DATED : August 8, 1989

INVENTOR(S) : David H. Neuroth

It is certified that error appears in the above-identified patent and that said Letters Patent is hereby corrected as shown below:

Claim 9, column 9, line 58, delete "electrical" and insert -- electrically --.

Claim 14, column 10, lines 31-32, delete "second" and insert -- first --.

Claim 14, column 10, line 34, after "comprises", insert -- a --.

Claim 16, column 10, line 48, delete "conductors" and insert -- conductor --.

Claim 21, column 11, line 13, after "tubular", insert -- member --.

Claim 24, column 11, line 56, delete "conductor" and insert -- connector --.

Claim 28, column 12, line 27, delete "compressible" and insert -- compressive --.

Claim 28, column 12, line 31, delete "compressible" and insert -- compressive --.

Claim 31, column 13, line 19, delete "compressible" and insert -- compressive --.

UNITED STATES PATENT AND TRADEMARK OFFICE

CERTIFICATE OF CORRECTION

PATENT NO. : 4,854,886

DATED : August 8, 1989

INVENTOR(S) : David H. Neuroth

It is certified that error appears in the above-identified patent and that said Letters Patent is hereby corrected as shown below:

Claim 31, column 13, line 14, delete "compressible" and insert -- compressive --.

Signed and Sealed this

First Day of January, 1991

*Attest:*

HARRY F. MANBECK, JR.

*Attesting Officer*

*Commissioner of Patents and Trademarks*